United States Patent [19]

Akutsu et al.

[11] Patent Number: 4,779,738

[45] Date of Patent: Oct. 25, 1988

[54] SYNTHETIC RESIN CONTAINER FORMED WITH SPIRAL NOTCHED LINE

[75] Inventors: Masao Akutsu; Nobuo Yamanaka, both of Tokyo, Japan

[73] Assignee: Yoshino Kogyosho Co., Ltd., Tokyo, Japan

[21] Appl. No.: 37,637

[22] Filed: Apr. 13, 1987

[51] Int. Cl.[4] ..... B65D 75/62

[52] U.S. Cl. ..... 206/627; 206/628; 220/270; 426/122; 426/123

[58] Field of Search ..... 206/627, 830, 601, 604, 206/605, 613, 616, 628, 629; 220/270; 426/115, 122, 123, 130

[56] References Cited

U.S. PATENT DOCUMENTS

| | | | |
|---|---|---|---|
| 1,436,754 | 11/1922 | Chadwick | 426/122 |
| 1,714,121 | 5/1929 | Barbieri | 206/627 X |
| 1,867,561 | 7/1932 | Bobrick | 206/627 X |
| 2,026,171 | 12/1935 | Heymann | 206/627 X |
| 2,132,966 | 11/1938 | O'Brien | 206/627 X |
| 2,179,504 | 11/1939 | Hasbrook | 206/627 X |
| 2,800,267 | 7/1957 | O'Neil | 206/627 |
| 3,214,078 | 10/1965 | Leezer | 206/613 |
| 3,955,001 | 5/1976 | Kuepack et al. | 206/627 X |
| 4,515,271 | 5/1985 | Auciello et al. | 206/627 X |
| 4,533,576 | 8/1985 | Tanahashi . | |
| 4,613,531 | 9/1986 | Gokcen et al. . | |

FOREIGN PATENT DOCUMENTS

| | | | |
|---|---|---|---|
| 0210725 | 5/1986 | European Pat. Off. . | |
| 538597 | 3/1922 | France | 206/627 |

*Primary Examiner*—Jimmy G. Foster

*Attorney, Agent, or Firm*—Parkhurst, Oliff & Berridge

[57] ABSTRACT

A synthetic resin container having a curved container body and a bottom plate peripherally sealed at the peripheral edge of the lower end opening of the container body which has a spiral notched line spirally formed on the container body from the top edge of the container body. Thus, the synthetic resin container is formed of type that the entirety is covered and can still be readily opened.

3 Claims, 2 Drawing Sheets

SYNTHETIC RESIN CONTAINER FORMED WITH SPIRAL NOTCHED LINE

BACKGROUND OF THE INVENTION

The present invention relates to a synthetic resin container for sealing foodstuff such as a custard pudding or ice cream or packaging a glass bottle and, more particularly, to a synthetic resin container formed with a spiral notched line.

Synthetic resin containers have heretofore been frequently employed as containers for sealing foodstuffs such as custard puddings or ice creams due to features such as inexpensiveness, high strength and nonpermeability. Further, packaging synthetic resin containers have also been used to protect and contain glass bottles. However, in a container having the structure entirely covered with a synthetic resin sheet which is difficult to collapse, it takes much effort to open such a container with frequent difficulties. Containers sealed at necks with aluminum sheets have also been utilized, but other means and steps of sealing the aluminum sheets have simultaneously required complicated steps in the manufacture thereof.

SUMMARY OF THE INVENTION

Accordingly, an object of the present invention is to provide a synthetic resin container which is of the type in which the entirety is covered and can still be readily opened in view of the above-mentioned drawbacks and disadvantages of prior art.

In order to achieve the above and other objects, there is provided according to the present invention a synthetic resin container having a curved container body and a bottom plate peripherally sealed at the peripheral edge of the lower end opening of the container body comprising a spiral notched line spirally formed on the container body from the top edge of the container body.

These and other objects and features will become more apparent from the following description of the preferred embodiments of the present invention when read in connection with the accompanying drawings.

DESCRIPTION OF THE PREFERRED EMBODIMENTS

Embodiments of a synthetic resin container according to the present invention will now be described in detail with reference to the accompanying drawings.

Figure 1:
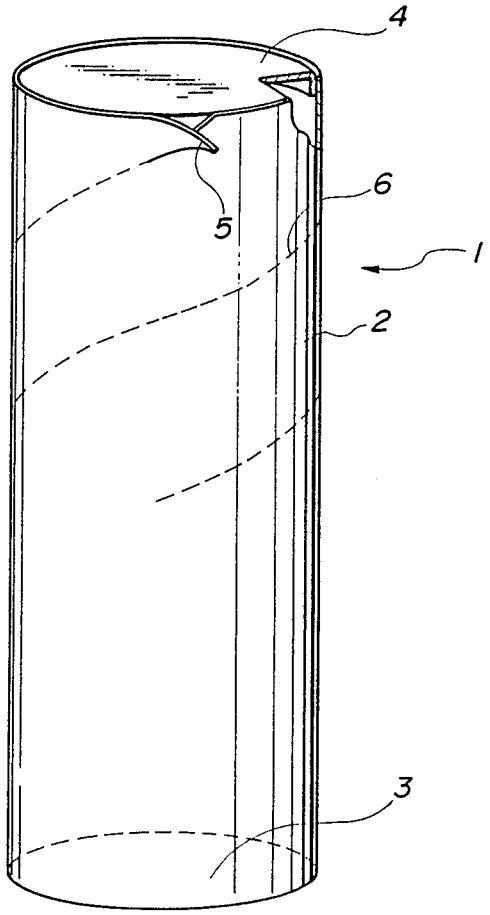
FIG. 1 is a perspective view of the profile of a first embodiment of a synthetic resin container formed with a spiral notched line partly designated according to the present invention.

FIG. 1 shows a first embodiment of a synthetic resin container according to the present invention. A synthetic resin container 1 comprises a cylindrical container body 2, a bottom plate 3 peripherally sealed at the peripheral edge of the lower end opening of the container body 2, and a top plate 4 peripherally sealed at the peripheral edge of the upper end opening of the container body 2. A notched line 6 is spirally formed on the container body 2 from a seal opening notch edge notched at the start of the notched line 6 at the top edge of the container body 2. In other words, the notched line 6 is notched from the top edge of the container body 2. Thus, the seal opening notch edge 5 can be readily raised by a finger nail, and can be then readily grasped by fingers. The end of the notched line 6 is determined according to the seal opening state of the container 1, the quantity and the shape of the content to be contained in the container 1, and may be notched to the bottom edge of the container body 2 on the entire container body 2, or may not always be notched to the bottom of the container body 2 along the axial direction of the body 2 as shown in FIG. 1.

The container 1 is formed by molding by an ordinary method known per se, and the notched line 6 is scribed by known means for spirally scribing the container body 2 by a cutter after molding. The notched line 6 may be scribed in necessary depth on the container body 2 to be preferably ½ or more of the thickness of the wall of the container body 2. The scribing of the notched line is preferably notching since the notching portion can be readily collapsed, and the notched line is preferably formed, for example, in a V-shaped sectional shape on the body container 2. The notched line 6 may be formed on the outer peripheral surface of the container body 2 or on the inner peripheral surface of the body 2.

The material of the container 1 is preferably polyolefin synthetic resin having flexibility and particularly preferably polyethylene.

The container 1 is fabricated by bonding the top plate 4 at the peripheral edge to the top opening of the container body 2 in a sealing manner, scribing or notching the notched line 6 on the container body 2, and then filling the content to be contained in the container 1. Then, the bottom plate 3 is bonded at the peripheral edge to the bottom opening of the container body 2 by known means, and the content is then sealed in the container 1. The notched line 6 may be scribed before bonding the top plate 4 to the top opening of the container body 2. When the content is removed from the container 1, the seal opening notch edge 5 is raised by a finger nail or the like, then grasped by fingers to spirally turn the seal opening notch edge 5 or the container itself in the spirally returning direction, and the container 1 is opened by pulling the seal opening notch edge 5 along the notched line 6.

In the first embodiment described above, the container is of cylindrical shape, but the container 1 may be of semispherical shape as designated and described below with respect to a second embodiment of the invention.

Figure 2:
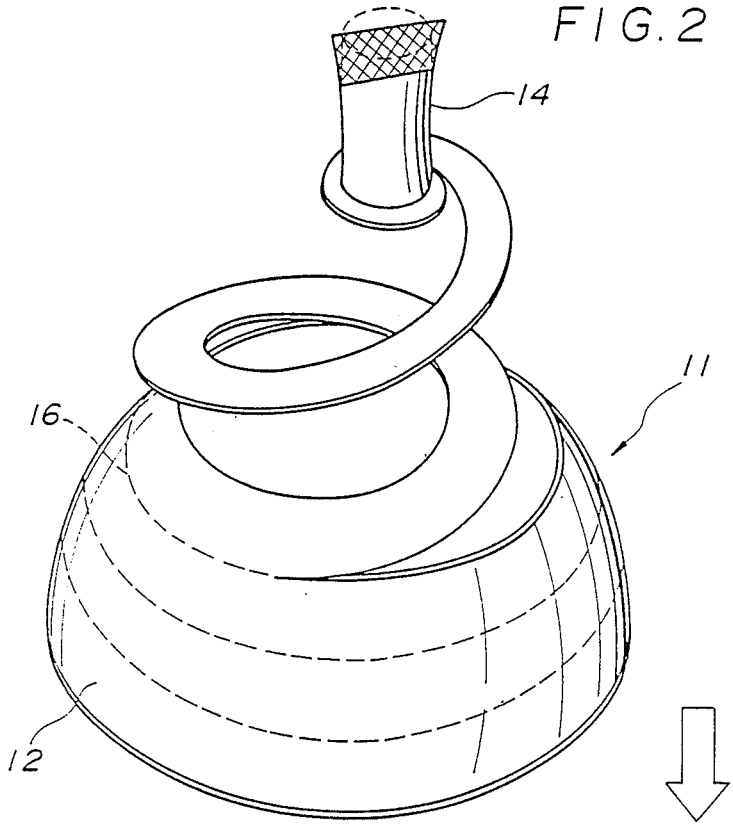
FIG. 2 is a perspective view of the profile of a second embodiment of a synthetic resin container formed with a spiral notched line partly collapsed from the top to be opened according to the invention.
Figure 3:
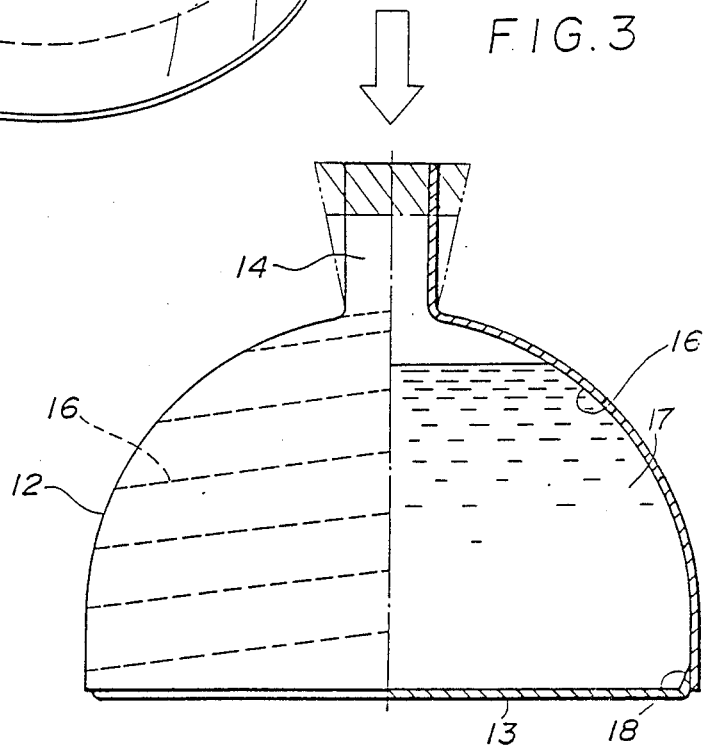
FIG. 3 is a side view of the second embodiment cut in section of the half portion.

A container 11 of second embodiment of the invention is fabricated by sealing the lower end opening of a semispherical container body 12 with a bottom plate 13, standing a small-diameter cylindrical filling neck 14 from the top of the container body 12 substantially perpendicularly from the top in a bottom plane of the container body 12, scribing a spiral notched line 16 on the wall of the container body 12 from the peripheral edge of the bottom of the neck 14, filling a content 17 in the container 11, and then bonding to seal the neck 14 in a sheetlike shape. Thus, when the content is removed from the container 11, the neck 14 is grasped by fingers, is then merely pulled, thereby sequentially collapsing the container body 12 from the neck 14 in a continuous strip shape along the notched line 16 on the container body 12 as shown in FIG. 2 to thus readily open the container 11.

The container of the second embodiment is formed of a synthetic resin material. In this case, the bottom plate 13 is fabricated of a separate member, the bottom plate 13 is erected at the peripheral edge thereof upwardly to form an erected peripheral edge 18 from the peripheral edge of the bottom plate 13, the peripheral edge 18 is bonded at the outer peripheral surface thereof in contact with the inner lower peripheral ed9e of the container body 12 to be integrally bonded by ultrasonic sealing to the inner lower peripheral edge of the container body 12. The neck 14 is collapsed in the opening in a sheetlike shape, bonded and sealed. The notched line 16 may be fomed on the inner or outer peripheral surface side of the wall of the container body 12.

As described above, the synthetic resin container of the present invention is constructed to form the spiral notched line from the seal opening notch edge on the container body. Therefore, when the seal opening notch edge is grasped by fingers and pulled, the container body can be readily collapsed in a continuous strip shape along the notched line, and can be very simply opened. Since the container is collapsed spirally from the seal opening notch edge sequentially toward the bottom, the portion grasped by the fingers can be finally retained to be sanitary and is adapted for a container for containing a foodstuff such as a custard pudding or ice cream which is readily collapsed in the shape or a protective packaging container of one or more glass bottles. Further, the container of the invention can be scribed or notched with an arbitrary notched line after the container is sufficiently patterned, and can be readily fabricated.

What is claimed is:

1. A container made of synthetic resin, comprising:

a curved container body of sheet material having an inner and an outer surface, said body having a top portion and a bottom portion;

a notched spiral shaped line on the outer surface of said container body and extending sdownwardly from a top edge of said container body; and a seal opening notch edge defined on and by the container body between an upper end of the notched line and the top edge of said container body for opening the container.

2. A container made of synthetic resin, comprising:

a container body portion;

a filling neck in fluid communication with and extending upwardly from an upper end of said container body; and a notched spiral shaped line on said container body and extedning downwardly from a junction of said filling neck with the container body.

3. The container according to claim 2, wherein said container body portion is of semispherical shape, and said filling neck is of cylindrical shape having a diameter smaller than said container body.

* * * * *